US008932683B1

(12) United States Patent
Kohlman et al.

(10) Patent No.: US 8,932,683 B1
(45) Date of Patent: Jan. 13, 2015

(54) METHOD FOR COATING A TOW WITH AN ELECTROSPUN NANOFIBER

(71) Applicant: United States of America as represented by the Administrator of the National Aeronautics and Space Administration, Washington, DC (US)

(72) Inventors: Lee W. Kohlman, Cleveland, OH (US); Gary D. Roberts, Wadsworth, OH (US)

(73) Assignee: United States of America as Represented by the Administrator of National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 13/918,333

(22) Filed: Jun. 14, 2013

Related U.S. Application Data

(60) Provisional application No. 61/660,163, filed on Jun. 15, 2012.

(51) Int. Cl.
*B05D 1/06* (2006.01)
*D01D 11/06* (2006.01)

(52) U.S. Cl.
CPC ..... *D01D 11/06* (2013.01)
USPC ..... 427/462; 427/483

(58) Field of Classification Search
USPC ..... 427/462, 483
See application file for complete search history.

(56) References Cited

U.S. PATENT DOCUMENTS

| | | | | |
|---|---|---|---|---|
| 6,265,333 | B1 * | 7/2001 | Dzenis et al. | 442/346 |
| 7,151,129 | B2 | 12/2006 | Ishikawa et al. | |
| 7,390,760 | B1 | 6/2008 | Chen et al. | |
| 7,485,591 | B2 | 2/2009 | Frey et al. | |
| 7,807,094 | B2 | 10/2010 | Kim et al. | |
| 7,832,983 | B2 | 11/2010 | Kruckenberg et al. | |
| 7,910,003 | B2 | 3/2011 | Ferrer et al. | |
| 2007/0207179 | A1 | 9/2007 | Andersen et al. | |
| 2010/0203315 | A1 | 8/2010 | Barrero Ripoll et al. | |
| 2011/0001086 | A1 | 1/2011 | Kruckenberg et al. | |
| 2011/0064949 | A1 * | 3/2011 | Bolick et al. | 428/394 |
| 2011/0183563 | A1 | 7/2011 | Ochi et al. | |

FOREIGN PATENT DOCUMENTS

| | | | | |
|---|---|---|---|---|
| WO | 2007/054029 | * | 5/2007 | D01D 5/00 |

* cited by examiner

*Primary Examiner* — Frederick Parker
(74) *Attorney, Agent, or Firm* — Robert H. Earp, III

(57) ABSTRACT

Method and apparatus for enhancing the durability as well as the strength and stiffness of prepreg fiber tows of the sort used in composite materials are disclosed. The method involves adhering electrospun fibers onto the surface of such composite materials as filament-wound composite objects and the surface of prepreg fiber tows of the sort that are subsequently used in the production of composite materials of the filament-wound, woven, and braided sorts. The apparatus performs the methods described herein.

10 Claims, 8 Drawing Sheets

METHOD FOR COATING A TOW WITH AN ELECTROSPUN NANOFIBER

CROSS-REFERENCE TO RELATED APPLICATIONS

This application claims the benefit of U.S. Provisional Patent Application Ser. No. 61/660,163 filed on Jun. 15, 2012. The entirety of the above-noted application is incorporated by reference herein.

ORIGIN OF THE INVENTION

The embodiment described herein was made by an employee of the United States Government and may be manufactured and used by or for the Government for Government purposes without the payment of any royalties thereon or therefore.

The invention described herein was also made in the performance of work under a NASA contract and is subject to the provisions of Section 305 of the National Aeronautics and Space Action of 1958, Public Law 85-568 (72 Stat. 435; 42 U.S.C. 2457).

FIELD OF THE INVENTION

The invention relates to fiber composite tows or yarns, in general, and, in particular, to methods and apparatus for deposition of electrospun nanofiber materials on fiber composite tows or yarns.

BACKGROUND OF THE INVENTION

Fiber-reinforced plastic, which is also known as fiber-reinforced polymer, and most generally as composite material, is made of a polymer matrix that is reinforced with fibers that are characterized by high strength and stiffness. The fibers are usually made from glass, carbon, quartz, basalt or aramid, although other fibers such as cellulose and asbestos are sometimes used. The polymer matrix is usually a thermosetting-type plastic such as epoxy, vinylester, bismaleimide, polyimide, phenolic, or polyester but other resins are also used. The fiber reinforcement can be present in various forms including continuous fibers, chopped fibers, woven fabrics, braided fabrics, or other forms. Fiber composites, especially those of the strongest and most rigid fiber, such as carbon fiber, can exhibit a significantly higher strength to weight ratio in comparison to metals, resulting in a potential weight savings of up to about 50 percent. Composite materials are commonly used in the aerospace, automotive, marine, and construction industries. Generally speaking, fiber composites have superior fatigue properties in comparison to metallic structures and are corrosion resistant. With such advantageous structural properties, fiber composites are most suitable for use in aircraft components.

Fiber composite materials are made by first creating bundles of fibers called tows or yarns that typically contain thousands of individual fibers. The fiber tows that are then dipped in polymer resin to produce a "towpreg" in which the resin is impregnated between the individual fibers in the tow. Alternatively, fiber tows can be combined side by side to form a sheet of fibers which are then dipped in a polymer resin or coated with a polymer resin to produce a "prepreg". The towpreg or prepreg material is then stacked in layers by processes such as filament winding, hand layup, and tape laying and cured by means of cross-linking of polymer chains by means of catalysts, heat, and/or radiation to form a rigid composite structure. An alternative process first forms the fiber tows into a "preform" fabric by weaving or braiding. The dry fabric can then be coated with a resin to form a woven or braided prepreg, or the thy fabric can be placed into a mold followed by infusion of the resin into the mold and curing of the composite within the mold.

One major difficulty in the use of fabricated fiber composite engineered products is that, during use when repeated stresses are applied to the final products, high local stresses develop within individual tows and between tows causing cracking within the fiber tows and delamination between tows that can lead to parts failure. There are methods by which to reduce the potential for such internal failure processes, such as by various modifications of and additions to the resin matrix material, so as to strengthen it. More generally speaking, toughening and other property enhancements of composite materials are typically implemented by modifying the bulk properties of the constituents, either the fiber or matrix materials, though this often leads to difficulties in processing and thus to higher costs.

Investigations of the failure and damage mechanisms of textile composites has led to the conclusion that toughening of the matrix material would result in increased material performance. In this regard, several methods have been used in which the bulk of the matrix is modified either through chemical formulation or the addition of fillers. However, such methods can detrimentally affect the processability of the resulting matrix material. Other methods exist that rely on modification of the fiber material (so-called "fuzzy fiber" approaches) that can also result in reduced fiber performance.

Attempts have been made to overcome the processing challenges associated with fiber composite production while improving the fiber's structural properties according to the final use of various composite structures. But there still exists a need for more efficient methods of enhancing or improving the structural properties of carbon and other fibers.

SUMMARY OF THE INVENTION

According to an embodiment of the invention, a method of coating a towpreg with electrospun fibers comprising the steps of coating a tow fiber bundle with a resin matrix material to form the towpreg; passing the towpreg through an electrospinning apparatus; and depositing an electrospun fiber on the towpreg. Further according to an embodiment of the invention, an apparatus for coating a towpreg with electrospun fibers includes a towpreg of a tow fiber bundle with a resin matrix material; a system for guiding the towpreg through an electrospinning apparatus; and the electrospinning apparatus for depositing an electrospun fiber on the towpreg.

DEFINITIONS

"Tow" or yarn refers to a group or bundle of fibers before coating with a resin.

"Prepreg" refers to tow, sheet of tows aligned in the same direction, or fabric dipped in a matrix material or resin but before curing.

"Towpreg" an individual tow which has been impregnated with uncured resin.

"Preform" refers to tows assembled into a fabric material which is then infused with a matrix material or resin during final processing by a variety of resin infusion methods. "Composite" and/or "composite material" refers to a rigid material that is formed upon curing of the resin material subsequent to the prepregging process or the resin infusion process.

BRIEF DESCRIPTION OF THE DRAWINGS

The structure, operation, and advantages of the present invention will become further apparent upon consideration of the following description taken in conjunction with the accompanying figures (Figures). The figures are intended to be illustrative, not limiting.

Certain elements in some of the figures may be omitted, or illustrated not-to-scale, for illustrative clarity. The cross-sectional views may be in the form of slices, or near-sighted cross-sectional views, omitting certain background lines which would otherwise be visible in a true cross-sectional view, for illustrative clarity.

Often, similar elements may be referred to by similar numbers in various figures (Figures) of the drawing, in which case typically the last two significant digits may be the same, the most significant digit being the number of the drawing figure (Figure).

FIG. 1 is a cross-sectional schematic view of a tow fiber bundle prior to immersion in a polymer resin matrix material, according to the present disclosure.

FIG. 2 is a cross-sectional schematic side view of a polymer resin bath with a tow fiber bundle going through it, according to the present disclosure.

FIG. 3 is a cross-sectional view of the composite material prepreg after the tow has been immersed in polymer resin, according to the present disclosure.

FIG. 4 is a cross-sectional view of a group of composite threads/yarns/tows that have been gathered into a bundle of composite material, according to the present disclosure. This is shown as all tows parallel, but would also include tows arranged with relative angle such as in filament wound structure with various angles between tows.

FIG. 5 is a schematic view that of the polymer resin bath of FIG. 2, modified in accordance with the present invention.

FIG. 6 is an oblique view of an electrospun fiber deposition chamber wherein electrospun nanofibers are deposited on towpreg, according to the present disclosure.

FIG. 7A is a schematic view of electrospinning apparatus in operation.

FIG. 7B is a schematic view of electrospinning apparatus operating in such a way that nanofiber precursor material falls in liquid droplets from the spinning needle.

FIG. 7C is a schematic view of electrospinning apparatus for operation in an inverted position, according to the present invention.

FIG. 8 is a cutaway orthogonal side view of an electrospinning fiber deposition chamber wherein towpreg receives a coating of electrospun fibers, according to the present disclosure.

FIG. 9 is an end-on sectional view through A-A of the electrospun fiber deposition chamber, according to the present disclosure.

Figure 10A:
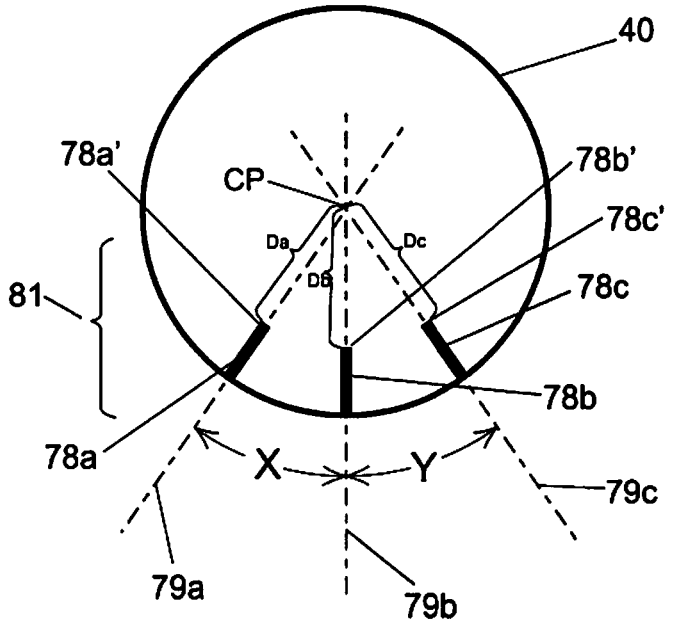

FIG. 10A is a schematic end-on view of the chamber, showing the locations and angles of the electrospinning fiber needles within the lower part of the chamber according to the present disclosure.

Figure 10B:
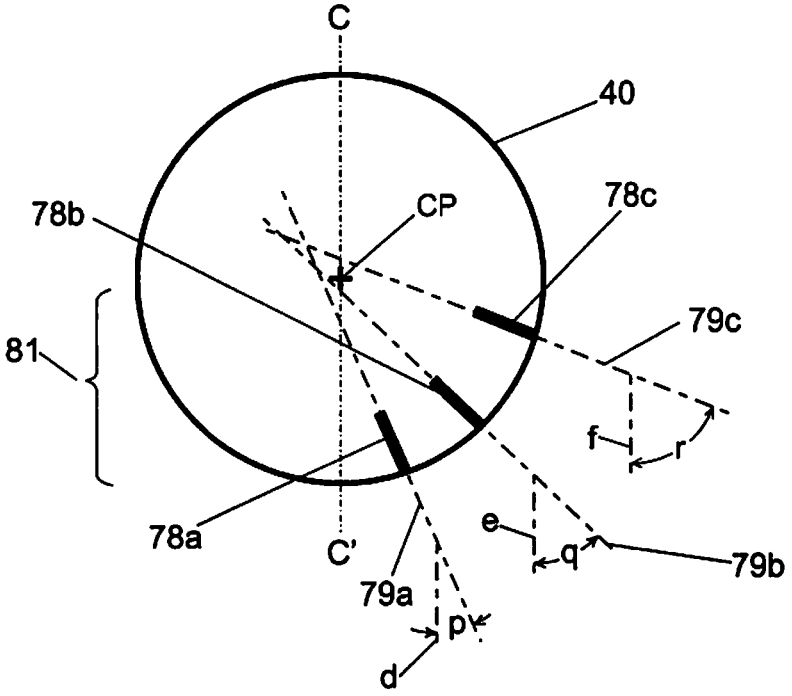

FIG. 10B is a schematic end-on view of the chamber, showing alternative locations and angles of the electrospinning fiber needles within the lower part of the chamber according to the present disclosure.

Figure 11:
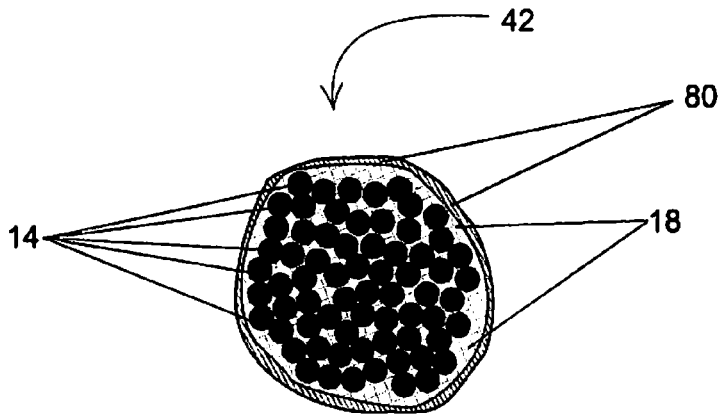

FIG. 11 is a cross-sectional view of a prepreg fiber bundle that has been coated with a layer of electrospun nanofibers, according to the present disclosure.

Figure 12:
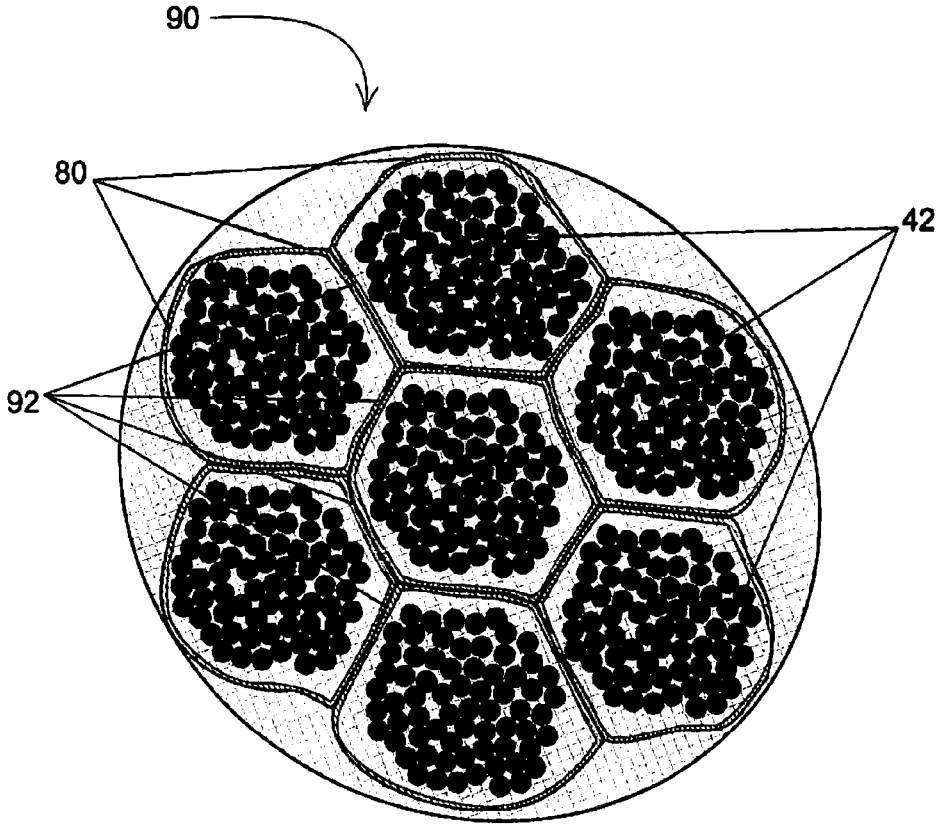

FIG. 12 is a cross-sectional view of a group of composite electrospun-nanofiber-coated threads/yarns/tows that have been gathered into a bundle of composite material, according to the present disclosure.

DETAILED DESCRIPTION OF THE PREFERRED EMBODIMENT

By using a direct electrospun deposition method to apply thermoplastic or other nanofiber materials to the surface of towpregs, the towpreg-towpreg, or tow-tow, interface in the resulting composite can be modified while using otherwise conventional materials and handling processes. Other materials of Electrospun fiber coated towpreg 42, at the right end of FIG. 6, reaches a pulley or roller 50, where its direction is reversed for a second pass through chamber 40 so as to receive a second coating of electrospun fiber, after which it exits through portal 41 and is guided by a wheel 53 toward further processing treatments. Companies that produce fabric products, such as those based on textiles or carbon, for use in composite material manufacturing, could apply direct electrospun deposition in their operations. Fiber-based composite materials could significantly benefit from local toughening through the use of electrospun, nanofiber coatings. Nanofibers, thermoplastic or otherwise, such as polyethersulfone, can be applied to the surface of a tow, prepreg, or fabric dipped in a matrix material or resin before curing, or the tow or fabric material infused with a matrix material or resin during final processing immediately after it has been coated with resin, achieving toughening of the fiber tow contact surfaces so as to result in tougher and more damage-resistant and tolerant composite structures. The same technique can also be applied to other technologies such as tape laying, fiber placement, and filament winding operations. Other modifications to the composite properties such as thermal and electrical conductivity can be made through selection of appropriate electrospun, nanofiber coatings of composite material tows and fiber bundles.

Typical tow material consists of many individual fibers (commonly~12,000) arranged in small bundles that are round in cross-section, or larger bundles that can be round or flattened some degree. The individual fibers are commonly made or carbon, though, for the purposes of the present embodiment, the fibers might be of any sort that confers strength, toughness, and stiffness to composite materials.

Composite materials can be fabricated from such tow by immersing the tow in polymer resin, or otherwise applying polymer resin to the tow, either prior to or after the tow has been woven, braided, filament wound or otherwise incorporated into practical engineered shapes and objects.

Figure 1:
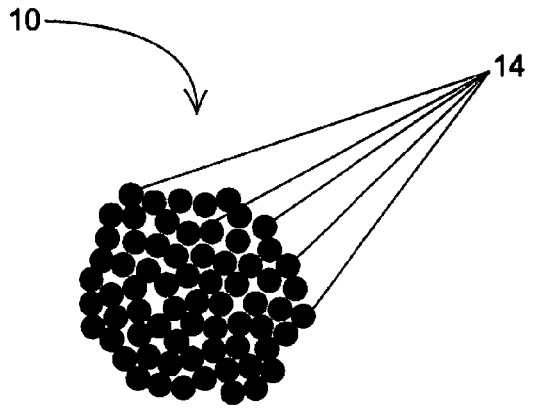

FIG. 1 is a cross-sectional view a tow fiber bundle 10 prior to immersion in a bath of a resin matrix material. The bundle 10 consists of separate strands of strength-giving fibers 14.

Figure 2:
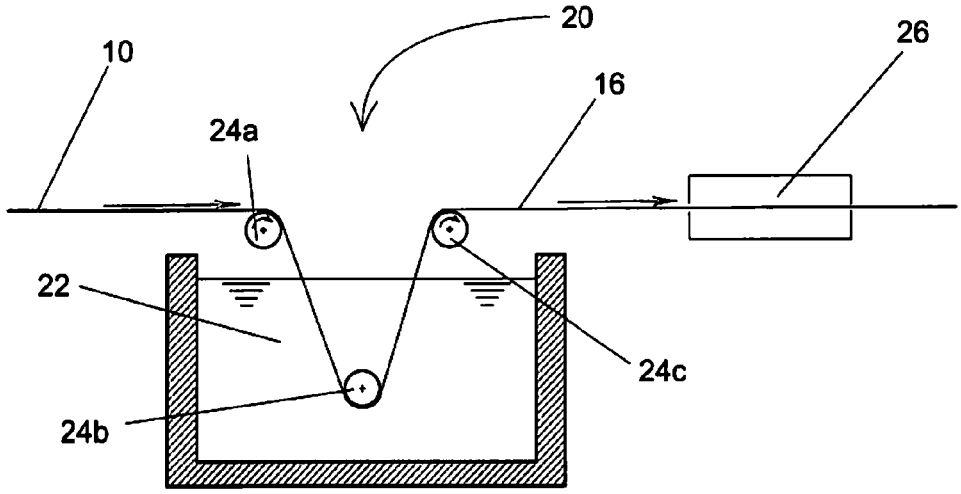

FIG. 2 is an orthogonal cross-sectional schematic side view of a bath 20 containing resin 22 with the tow fiber bundle 10 being immersed as it travels (direction is indicated by the arrows) over a first pulley 24*a*, a second pulley 24*b*, which is submerged in the resin, and then emerging onto as a towpreg 16 and being guided by a third pulley 24*c* to further treatments such as curing of the resin and later hardening and/or giving it further treatments in a region 26.

Figure 3:
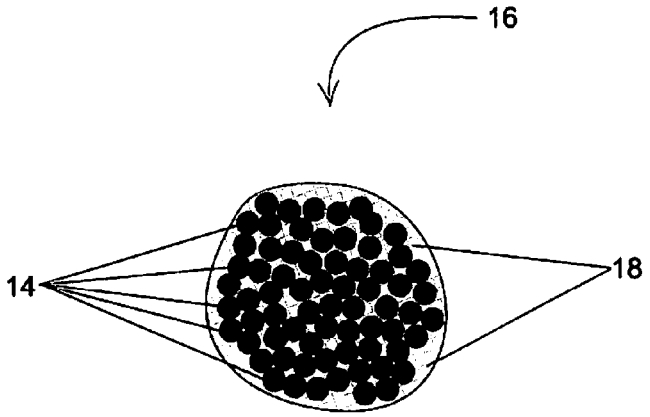

FIG. 3 is a cross-sectional view of the prepreg of composite material tow 16 consisting of the tow fiber 10 of FIG. 1 after it has been immersed in the resin 22 in resin bath 20. Towpreg 16 consists of the same types of carbon or other fibers 14 which are now shown embedded in a matrix polymer resin 18.

Figure 4:
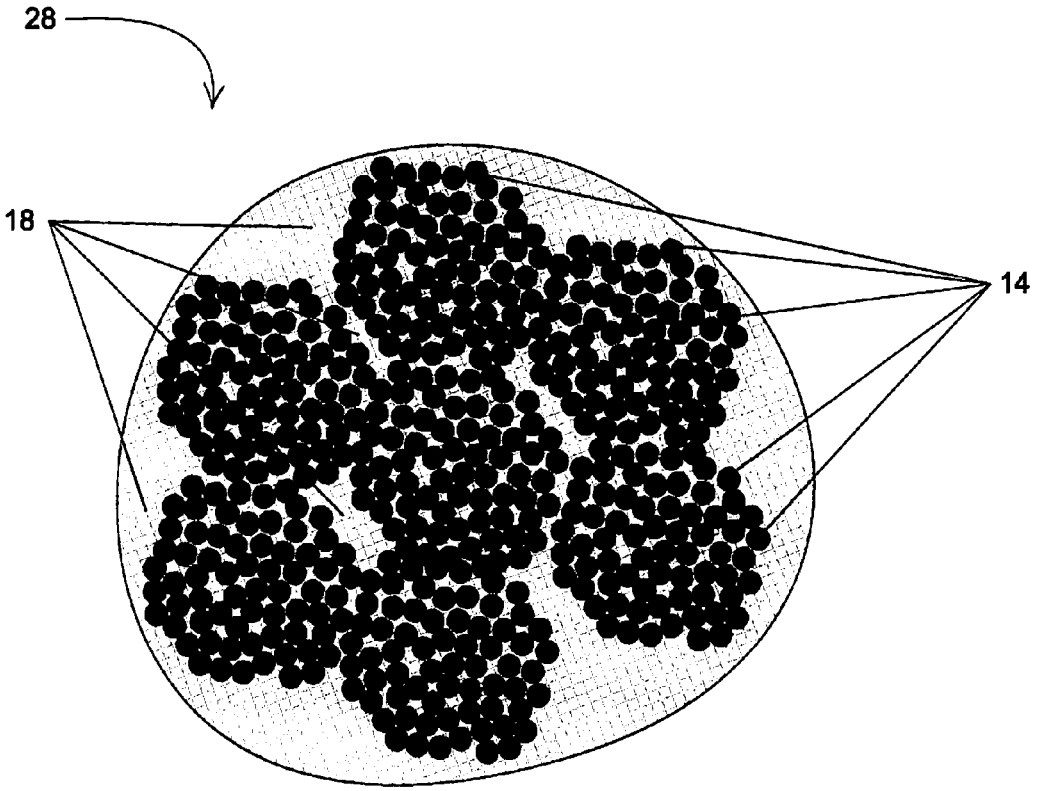

FIG. 4 is a cross-sectional view of a group of composite towpreg threads/yarns/tows 16, containing fibers 14, gathered into a unidirectional bundle of composite material 28.

Figure 5:
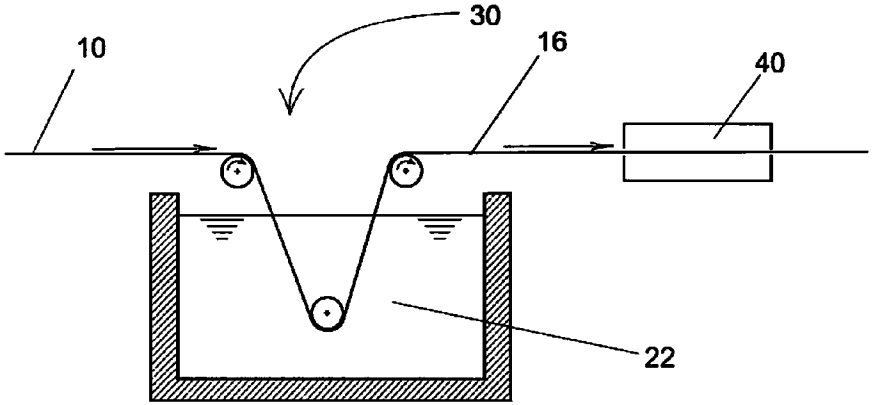

FIG. 5 shows the process of FIG. 2 altered according to the preferred embodiment by the addition of a chamber 40 wherein the original tow fiber bundle 10, after having been coated with resin 22 in the bath 20 and becoming the towpreg 16, then receives a coating of electrospun fibers, as described below, in the chamber 40.

Figure 6:
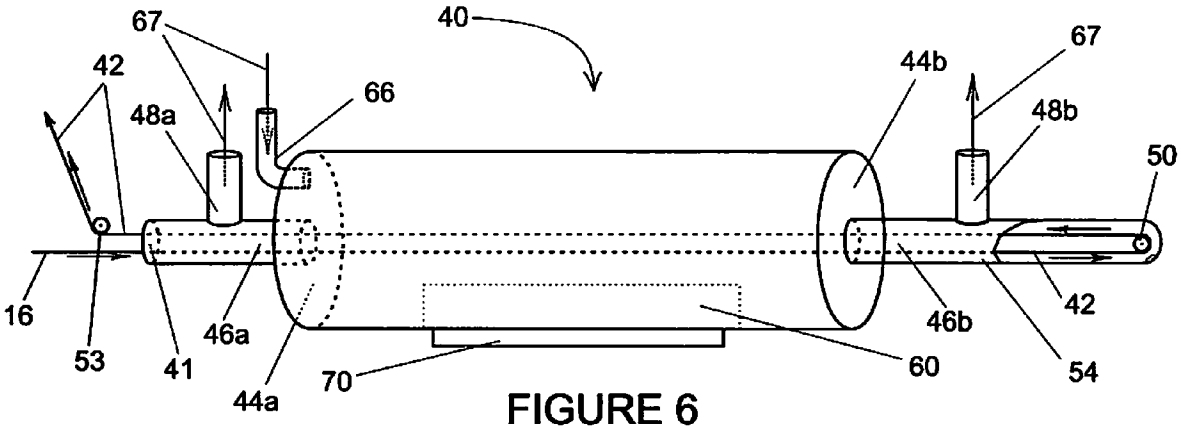

FIG. 6 is an oblique view of the chamber 40, showing the resin-coated tow or towpreg 16 entering the chamber through a left enter/exit portal 41 on the left side of the view and traversing the chamber (dotted line) to receive a first coating of electrospun fibers (not shown) on its surface, as discussed below, and thus to become electrospun-fiber coated towpreg 42.

Electrospun fiber coated towpreg 42, at the right end of FIG. 6, reaches a pulley or roller 50, where its direction is reversed for a second pass through chamber 40 so as to receive a second coating of electrospun fiber, after which it exits through portal 41 and is guided by a wheel 53 toward further processing treatments. The pulley 50 is housed within an extension 54 shown in partial cutaway view at the right end. The chamber 40 has a left end 44*a* and a right end 44*b* having attached respectively thereto a left vent connection housing 46*a* and a right vent connection 46*b*. Alternately, the tow could pass through coating chamber once.

The left vent connection 46*a* is a conduit for the towpreg fiber bundle 10 as it enters the chamber 40 and the electrospun-fiber-coated towpreg 42 as it exits after having been so coated inside the chamber. Tail piece 48*a* on the left vent connection 46*a* connects to pressure and ventilation gas handlers (not shown) so as to control the internal environment of chamber 40 with respect to such variables as temperature, humidity, and flow rate of air or other gas. Tail piece 48*b* on the right vent connection 46*b* likewise connects to pressure and ventilation gas handlers (not shown) so as to control the internal environment of the chamber 40 and to recover solvent that evaporates during the electrospinning process.

The right vent connection 46*b* contains the pulley 50 over which the electrospun-fiber-coated towpreg 42 moves so as to reverse its direction for a second pass through chamber 40. Positive air pressure is maintained inside chamber 40 by the introduction of purge air 67 (arrow) through an inlet conduit 66 shown at the top left end of the chamber. Purge air 67 exits from chamber 40 by way of the tail pieces 48*a*,48*b* of the vent connections 46*a*,46*b* at each end 44*a*,44*b* of the chamber 40. There is located in the bottom of chamber 40, within the region 60 denoted by a dotted line, a plurality of upward-pointing electrospinning needle injectors, as will be discussed in greater detail in relation to FIGS. 8 and 9. The electrospinning needles could also be replaced with a roller/bath type electrospinning coater or other high volume electrospinning device.

In FIG. 6, a housing 70 at the bottom of chamber 40 contains pressurized reservoirs (not shown) for delivery of nanofiber precursor material (not shown) that is ejected by the electrospinning needle injectors disposed (but not shown in this FIGURE) within the region 60 in the bottom region of chamber 40.

Figure 7B:
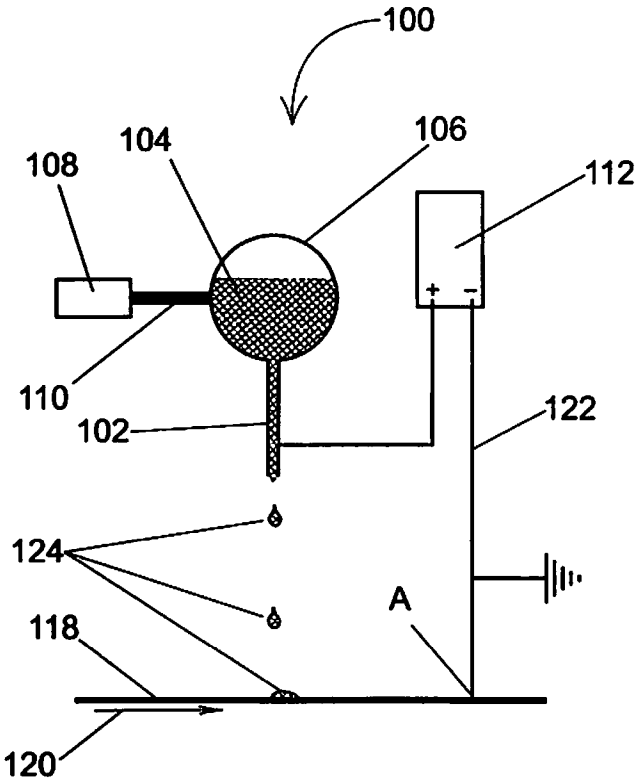
Figure 7A:
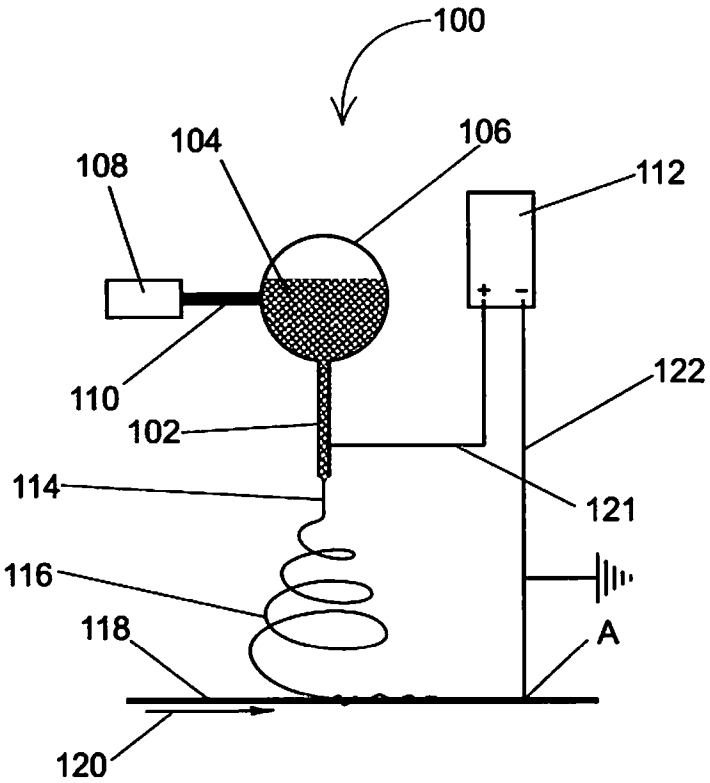
Figure 7C:
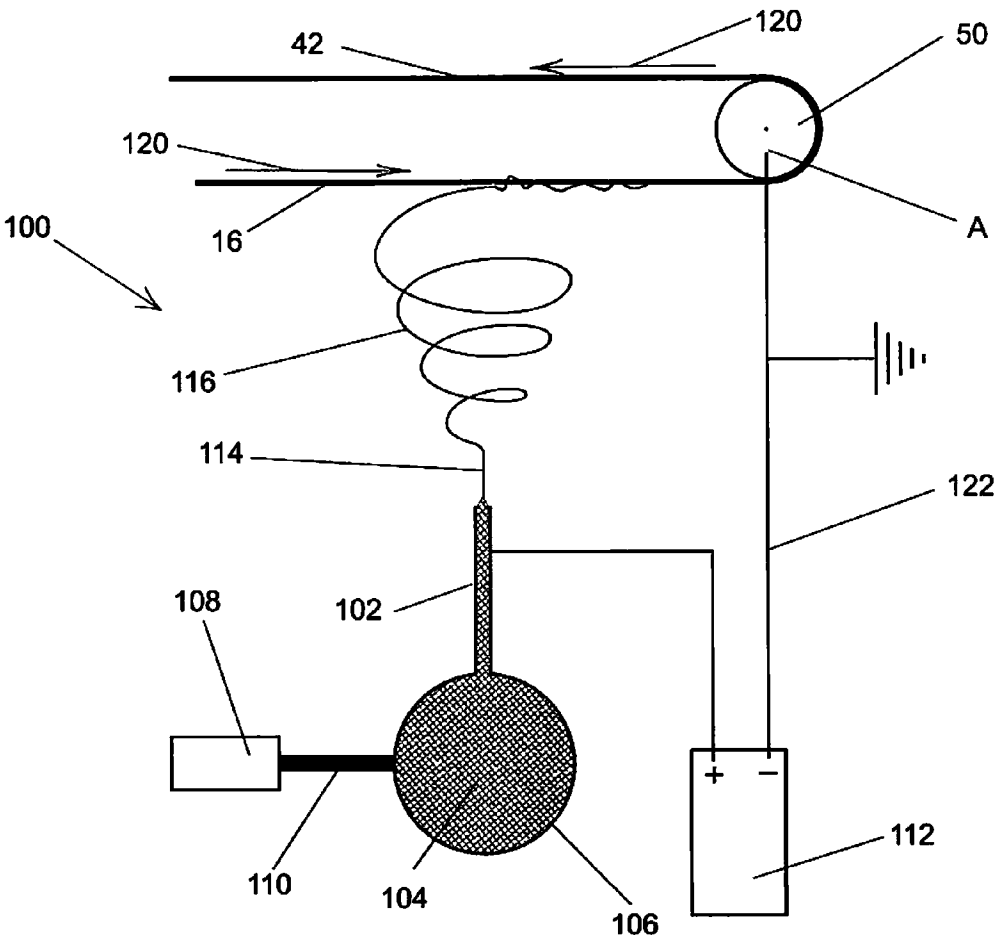
Figure 9:
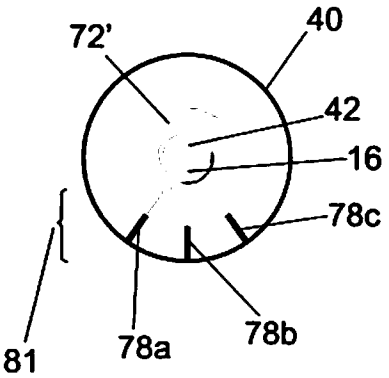

The region 60, which contains a multiplicity of electrospinning needle injectors (shown in detail in FIGS. 8 and 9 and numbered as 74*a*,74*b*,74*c*,76*a*,76*b*,76*c*,78*a*,78*b*,78*c*), is disposed in the lower region of chamber 40 for reasons that are illustrated in FIGS. 7A,7B, and 7C. FIG. 7A is a schematic view of an electrospinning apparatus 100 in which an electrospun nanofiber 116 is being deposited upon a substrate 118 that is moving in a direction as indicated by the arrow 120. The electrospinning apparatus 100 consists of a needle 102 that conveys electrospinning precursor fluid 104 from a reservoir 106 with which the needle communicates. A pump 108 supplies the pressured fluid 104 to the reservoir 106 by way of s conduit 110. A high-voltage power supply 112, operating at a voltage of between about 5,000 volts and 50,000 volts, conveys, by way of electrical connection 121, an electrical charge to the needles, while the substrate material 118 is maintained in an electrically grounded state by way of electrical connection 122 from the power supply to a location A on the substrate material. Note that the needle 102 emits a jet 114 of electrically charged nanofiber precursor material 104 which is drawn towards the electrically grounded substrate material 118 that is formed of a towpreg. After the jet 114 of electrically charged nanofiber precursor material 104 leaves the needle 102, the precursor material immediately beginning to thicken as solvent within the precursor material begins to evaporate, and, as doing so the jet transforms into the nanofiber 116 which, because it moves relatively slowly from the needle 102, and also because of electric charge which it carries, takes on a moving shape more or less as illustrated in the spiral nanofiber's spiral aspect. During the electrospinning process, the jet 114 appears to an observer as, more or less, a straight filament, which the fast-moving nanofiber itself 116, has an appearance resembling that of an expanding cloud of spray particles which, in FIGS. 8 and 9, are represented as clouds 72 and 72'.

FIG. 7B is a schematic view of the same arrangement of FIG. 7A, but with liquid droplets falling from the needle 102. The point here is to indicate that sometimes, during the electrospinning process, the jet 114 fails to consolidate as a jet, and droplets 124 can form, the result being that the droplets, which have a low surface-to-volume ratio compared to the jet 114 and nanofiber 116 does not readily dissipate the solvent component of the precursor material 104. The still wet droplets 124 of nanofiber precursor material 104 thus can fall downward upon the substrate material 118, which it can soak into and, because of its solvent component or components, have a deleterious effect upon the substrate.

In the case of the present invention, the substrate material 118 is towpreg 16, as shown in FIG. 6. Thus, as shown in FIG. 7C, the needle 102 is shown disposed beneath the towpreg 16, with the jet 114 and nanofiber 116 being projected upward so that if or when droplets emerge from the needle, they will fall on the chamber and away from the towpreg 16 that is undergoing an electrospun nanofiber coating process 100.

Figure 8:
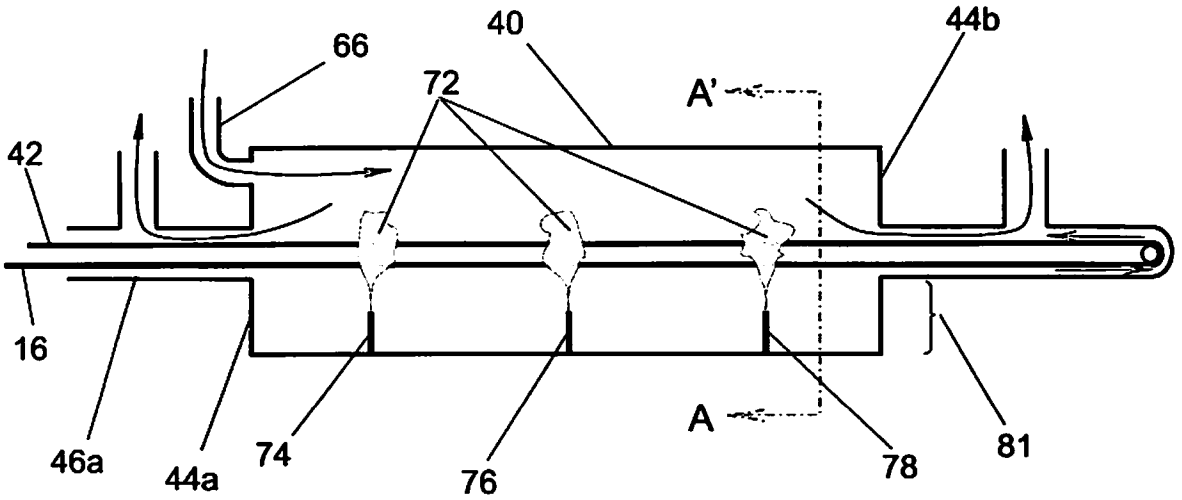

FIG. 8 is a schematic cross-sectional side view of the chamber 40 wherein the resin-coated towpreg 16 receives a coating of electrospun fibers 72 which, as explained in relation to FIGS. 7A,7B and 7C, are shown as "clouds" 72 from three arrays 74,76,78 of electrified nanofiber injector needles. Each array 74,76,78 consists of three needles 74*a*,74*b*,74*c*,76*a*,76*b*,76*c*,78*a*,78*b*,78*c* (FIG. 9). The resin-coated towpreg 16 is maintained in an electrically grounded state during the electrospinning coating operation. FIG. 9 is an end-on view, according to section A-A of FIG. 7, showing right-most needle array 78 displayed as three electrically charged needles 78*a*,78*b*,78*c*. While three arrays 74,76,78 are illustrated, it is within the terms of the preferred embodiment to have two or more arrays. Also, it is within the terms of the preferred embodiment to have two or more needles in each array.

In FIG. 8, the three "clouds" 72, representing what are fast-moving, continuous strands of polymeric nanofiber, one from each injection needle in each array 74,76,78 of three needles, that, before being deposited upon the grounded towpreg 16,42, whip about at high speed so as to appear as a cloud or a spray.

In FIG. 9, "clouds" 72' represent end-on views of overlapping nanofibers moving from nine electrospinning injector needles 74*a*,74*b*,74*c*,76*a*,76*b*,76*c*,78*a*,78*b*,78*c*.

In FIGS. 8 and 9, the nanofiber needle arrays 74,76,78, and needles 74*a*,74*b*,74*c*,76*a*,76*b*,76*c*,78*a*,78*b*,78*c* are disposed in the lower region 81 of the chamber 40 as explained in relation to FIG. 7C. FIG. 10A is a more detailed cross-sectional view of FIG. 9, showing the locational and angular relationships of the of the needles 78*a*,78*b*,78*c* of needle array 78 with respect to one another and with respect to chamber 40. The other needle arrays 74,76 (not shown in FIG. 10A) and the respective needles within each, 74*a*,74*b*74*c*, 76*a*,76*b*,76*c*, are intended herein to be according to similar locational and angular relationships.

In the view of FIG. 10A, the needles 78*a*,78*b*,78*c* all point to a center point CP within the chamber 40; that is to say, the respective axes 79*a*,79*b*,79*c* converge at center point CP, in this representative view. The respective axes 79*a*,79*b*,79*c* stand in angular relationship to one another according to the angles X and Y, which might or might not be equal angles. Angles X and Y can be between 10° and 90° and preferably between 30° and 60°. The tip 78*a*' of needle 78*a* is at a distance of Da from the center point CP, while the tip 78*b*' of needle 78*b* is at a distance Db from center point CP, and the tip 78*c*' of needle 78*c* is at a distance Dc from center point CP. It is anticipated by the inventors that the distances Da,Db,Dc might be equal or different from one another.

FIG. 10B is another detailed cross-sectional view that is intended to show alternative locational and angular relationships of the needles 78*a*,78*b*,78*c* of needle array 78 with respect to one another and with respect to chamber 40. The other needle arrays 74,76 (not shown in FIG. 10B) and the respective needles within each, 74*a*,74*b*74*c*,76*a*,76*b*,76*c*, are intended herein to be according to similar locational and angular relationships. Note that the respective axes 79*a*,79*b*, 79*c* of the needles 78*a*,78*b*,78*c* do not necessarily converge at the center point CP, and that their respective angles p,q,r preferably between 0° and 90° with respect to the vertical reference lines d,e,f are not necessarily equal to one another. Note yet further, in the view shown in FIG. 10B, that the needles 78*a*,78*b*,78*c*, while shown to be located within the lower region 81 of chamber 40, are all shown to be on one side of the center line C-C' of the chamber, which is meant to indicate that the needles can be, if deemed beneficial to the implementation of the present invention, can be so located within the spirit of this disclosure.

During the electrospinning deposition process shown in the FIGS. 8 and 9, control of the electrical potential of the needles 74*a*,74*b*,74*c*,76*a*,76*b*,76*c*,78*a*,78*b*,78*c* as well as control of precursor solutions of the precursor spinning material, with respect to such variables as viscosity and density and/or additives, and also, inside chamber 40, the air temperature and humidity, airflow rate, pressure, and other variables are used to vary the diameter and nanofiber coating morphology as needed. Post-coating heat treatments may also be used for the purpose of curing, drying, oxidation, annealing, etc. The arrays 74,76,78 of electrospinning needles 74*a*,74*b*,74*c*, 76*a*,76*b*,76*c*,78*a*,78*b*,78*c* may be varied in their locational relationships, as described above in reference to FIGS. 7A,7B and 7C, so as to achieve uniform, quality coatings, and may involve the controlled use of gas flow within the chamber 40 so as to direct and otherwise control nanofiber deposition. An adhesive coating may also be applied (pre- or post-application) to the receiving material 16,42 so as to enhance the mechanical stability of the nanofiber coating. Additionally, any number of different nanofiber materials can be simultaneously applied. And the number and arrangement of the electrospinning needles and arrays can be varied.

FIG. 11 is a cross-sectional view of a towpreg fiber bundle 42, having fibers 14 and matrix polymer resin 18, that is coated with a layer 80 of electrospun nanofiber.

FIG. 12, which is analogous to FIG. 4, is a cross-sectional view of a group of unidirectional electrospun nanofiber-coated towpreg threads/yarns/tows 42, gathered into a bundle of composite material 90 wherein regions of contact 92 are of respective electrospun coating layers 80, which locally reinforces the resin in the interface and increases fracture toughness.

This invention produces a product with an electrospun fiber toughening agent applied to the surfaces of fiber tow or other continuous composite precursor material where it is needed (at interfaces and boundaries) without interfering with other composite processing characteristics.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a means) used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A method of coating a towpreg with electrospun fibers, comprising:

providing the towpreg of a tow fiber bundle impregnated with a resin matrix material;

passing the towpreg through an electrospinning apparatus; and depositing an electrospun fiber on the towpreg.

2. The method of claim 1 including immersing the tow fiber bundle in a resin matrix material to form the towpreg.

3. The method of claim 2 including forming the tow fiber bundle from a unidirectional bundle of composite threads containing fibers.

4. The method of claim 2 including depositing the electrospun fiber on the towpreg with the electrospinning apparatus.

5. The method of claim 4 including depositing electrospun fiber of electrospun nanofibers.

6. The method of claim 4 including:

passing the towpreg through a chamber containing the electrospinning apparatus;

providing the electrospinning apparatus with a plurality of electrospinning needles for ejecting a nanofiber precursor material as a jet in the direction of the towpreg.

7. The method of claim 6 including:

maintaining the towpreg in an electrically grounded state while the towpreg passes through the chamber containing the electrospinning apparatus;

electrically charging the electrospinning needles whereby the nanofiber precursor material being ejected from the electrospinning needles as jets carries an electric charge and is drawn towards the electrically grounded towpreg.

8. The method of claim 7 including disposing the electrospinning needles beneath the towpreg whereby droplets emerging from the needle will fall on the chamber instead of towpreg.

9. The method of claim 8 including providing a plurality of arrays of electrospinning needles each spaced from each other along a lower region of the chamber.

10. The method of claim 9 including passing the towpreg through the chamber containing the electrospinning apparatus in a first direction and then reversing the direction of the towpreg and passing it through the chamber to receive a second coating of electrospun fiber.

* * * * *